US007597730B2

(12) United States Patent
Yoo et al.

(10) Patent No.: US 7,597,730 B2
(45) Date of Patent: Oct. 6, 2009

(54) DUST COLLECTION APPARATUS FOR VACUUM CLEANER

(75) Inventors: Dong-hun Yoo, Gwangju (KR); Myoung-sun Choung, Gwangju (KR); Jae-sun You, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 588 days.

(21) Appl. No.: 11/367,946

(22) Filed: Mar. 3, 2006

(65) Prior Publication Data

US 2007/0011998 A1 Jan. 18, 2007

Related U.S. Application Data

(60) Provisional application No. 60/698,449, filed on Jul. 12, 2005.

(30) Foreign Application Priority Data

Aug. 16, 2005 (KR) ..... 10-2005-0074952

(51) Int. Cl.
*B01D 45/12* (2006.01)

(52) U.S. Cl. ..... 55/337; 55/424; 55/429; 55/456; 55/DIG. 3

(58) Field of Classification Search ..... 55/337, 55/424, 429, 456, 459.1, DIG. 3
See application file for complete search history.

(56) References Cited

U.S. PATENT DOCUMENTS 7,395,579 B2 * 7/2008 Oh ..... 15/347
7,422,615 B2 * 9/2008 Kim ..... 55/426

FOREIGN PATENT DOCUMENTS

| | | |
|---|---|---|
| EP | 1743560 | 1/2007 |
| GB | 2376175 | 12/2002 |
| GB | 2398734 | 9/2004 |
| GB | 2406064 | 3/2005 |
| GB | 2420514 | 5/2006 |

OTHER PUBLICATIONS

British Search Report dated Jun. 19, 2006 issued in connection to corresponding British Patent Application No. 0605869.7 filed on Mar. 23, 2006.
Examination Report dated Apr. 28, 2008 corresponding to United Kingdom Patent Application No. 0605869.7.

* cited by examiner

*Primary Examiner*—Robert A Hopkins
(74) *Attorney, Agent, or Firm*—Ohlandt, Greeley, Ruggiero & Perle, L.L.P.

(57) ABSTRACT

A dust collecting apparatus for a vacuum cleaner including a cyclone body provided with a cyclone chamber and a contaminant collecting chamber formed therein, a cyclone case provided in the cyclone body having the cyclone chamber and the contaminant collecting chamber separated from each other; an air inflow tube penetrating an outer wall of the cyclone body such that a suction passage at an outside of the cyclone body is fluidly communicated with a lower end of the cyclone chamber; and an air outlet tube penetrating sequentially a bottom of the cyclone case and a bottom the cyclone body to guide the air discharged from the cyclone chamber to a discharge passage placed at an outside of the cyclone body, wherein the contaminant collecting chamber is connected to the cyclone chamber through a contaminant discharge port formed at a side surface of upper end of the cyclone chamber.

15 Claims, 4 Drawing Sheets

DUST COLLECTION APPARATUS FOR VACUUM CLEANER

CROSS-REFERENCE TO RELATED APPLICATIONS

This application claims the benefit of U.S. Provisional Application No. 60/698,449 filed on Jul. 12, 2005 in the United States Patent and Trademark Office, and claims the benefit of Korean Patent Application No. 2005-74952 filed on Aug. 16, 2005 in the Korean Intellectual Property Office, the entire contents of each of these applications is incorporated herein by reference.

BACKGROUND OF THE INVENTION

1. Field of the Invention

The present invention relates to a vacuum cleaner. More particularly, the present invention relates to a dust collecting apparatus for a vacuum cleaner for separating contaminants from drawn-in air.

2. Description of the Related Art

In general, a vacuum cleaner is an apparatus for cleaning a surface by drawing in contaminants on the surface being cleaned along with ambient air and separating the contaminants from the drawn-in air. Such a vacuum cleaner comprises a dust collecting apparatus for collecting the contaminants separated from the drawn-in air. Recently, a cyclone dust collecting apparatus for separating contaminants from the drawn-in exterior air using a centrifugal force has been developed. Compared to a conventional dust bag, the cyclone dust collecting apparatus is relatively permanent and clean, so the cyclone dust collecting apparatus is more widely used.

Generally, in the conventional cyclone dust collecting apparatus, a cyclone chamber in which the drawn-in air is whirled and a contaminant collecting chamber in which contaminants separated from the drawn-in air by centrifugal force are collected are formed as one space. In this case, contaminants collected in the contaminant collecting chamber are scattered by the air flow, and the contaminants are then discharged along with the air being discharged from the dust collecting apparatus. In addition, when the position of the vacuum is changed, contaminants collected in the contaminant collecting chamber may flow out from the dust collecting apparatus. Thus, the conventional dust collecting apparatus has a problem: deteriorating dust collection efficiency due to this outflow of contaminants.

SUMMARY OF THE INVENTION

An object of the present invention is to solve at least the above problems and/or disadvantages and to provide at least the advantages described below. Accordingly, an object of the present invention is to provide a dust collecting apparatus of a vacuum cleaner, which can prevent contaminants separated in a cyclone chamber from being discharged to the outside of the dust collecting apparatus.

According to one embodiment proposed to achieve the above-described object, there is provided a dust collecting apparatus for a vacuum cleaner comprising a cyclone body provided with a cyclone chamber and a contaminant collecting chamber formed therein, the cyclone chamber being a space in which air entering from the exterior ascends in the opposite direction to gravity in a whirling manner and contaminant is separated from the air by a centrifugal force generated by the whirling air, and the contaminant collecting chamber being a space in which the contaminant separated from the air is accumulated; a cyclone case provided in the cyclone body and disposed at an upper side of the contaminant collecting chamber, the cyclone case having the a cyclone chamber and the contaminant collecting chamber separated from each other; an air inflow tube penetrating an outer wall of the cyclone body such that a suction passage at an outside of the cyclone body is fluidly communicated with a lower end of the cyclone chamber; and an air outlet tube penetrating sequentially a bottom of the cyclone case and a bottom the cyclone body to guide the air discharged from the cyclone chamber to a discharge passage placed at an outside of the cyclone body. In the dust collecting apparatus, the contaminant collecting chamber is connected to the cyclone chamber through a contaminant discharge port formed at a side surface of upper end of the cyclone chamber.

Accordingly, since the cyclone chamber and the contaminant collecting chamber are formed independently, it is possible to prevent contaminants collected in the contaminant collecting chamber from being re-scattered by an air flow and from entering the cyclone chamber.

According to one preferred embodiment, the air inflow tube has one side fixed to the cyclone body to support the cyclone case, the cyclone body comprises an upper case in which the cyclone case is provided and a contaminant collecting receptacle having the contaminant collecting chamber formed therein, the cyclone contaminant collecting chamber is detachably combined with an opened lower end of the upper case, and the air inflow tube is passed between the upper case and the contaminant collecting receptacle.

In addition, the air outlet tube is provided with an air discharge port formed at an upper end thereof for allowing the air discharged from the cyclone chamber to enter therein, and a portion of the upper end of the air outlet tube is protruded to an inside of the cyclone chamber to dispose the air discharge port between the bottom surface of the cyclone case and the contaminant discharge port.

The air outlet tube comprises a first air outlet tube portion extended upward from the bottom surface of the cyclone body and a second air outlet tube portion extended upward from the bottom surface of the cyclone case and connected with an upper end of the first air outlet tube portion, the air outlet tube supports the cyclone case when the first and second air outlet tube portions are connected with each other. Further, the air outlet tube is formed such that an inner diameter is gradually increased toward the bottom of the cyclone body.

The cyclone body may comprise the upper case surrounding the cyclone with a certain gap and having an opened lower end; the containment collecting case being combined detachably with a lower end of the upper case and having the containment collecting chamber formed therein; a support body provided at a combining portion of the upper case and the contaminant collecting receptacle; and at least one supporting rib connecting the support body and the cyclone case to support the cyclone case on an upper side of the contaminant case. The contaminant discharged through the contaminant discharge port is fallen by its weight, passed sequentially between the cyclone case and the upper case and between at least one supporting ribs and then collected in the contaminant collecting chamber. Further, the air inflow tube, the supporting rib and the cyclone case are formed integrally with each other.

The support body is formed into a ring shape and is disposed between the upper case and the contaminant collecting receptacle, the supporting ribs are provided radially about the cyclone case. Also, a portion of the support body is protruded to an inside of the cyclone body, at least one of the support body and the supporting ribs prevent the contaminant in the contaminant collecting chamber from flowing to the upper case when the cyclone body is inclined.

An upper end of the cyclone case and an upper sidewall of the cyclone body are spaced apart from each other at a certain distance to form the contaminant discharge port. Further, the dust collecting apparatus further comprises a grill member covering the contaminant discharge port for filtering the air drawn in the contaminant discharge port.

Also, the cyclone body may comprise a backflow preventing protrusion being protruded downward from the upper sidewall for preventing the contaminant in the contaminant collecting chamber from re-entering to an inside of the cyclone chamber. Further, the backflow preventing protrusion is formed into a cylindrical shape and has an opened lower end disposed at an upper side of the cyclone case, and the backflow preventing protrusion has an inner diameter larger than that of the cyclone case.

The cyclone body has a lower cover comprising a penetrating hole for communicating the outlet of the air outlet tube with the discharge passage, and being mounted to a lower end of the cyclone body for opening and closing the lower end; and a filter member provided detachably between the lower cover and the outlet of the air outlet tube.

Further, the cyclone case comprises a spirally shaped guide member for guiding the air drawn in through the air inflow tube to make the air ascend and whirl in the cyclone chamber.

BRIEF DESCRIPTION OF THE DRAWING FIGURES

The above aspect and other features of the present invention will become more apparent by describing in detail exemplary embodiments thereof with reference to the attached drawing figures, wherein.

DETAILED DESCRIPTION OF THE INVENTION

Figure 1:
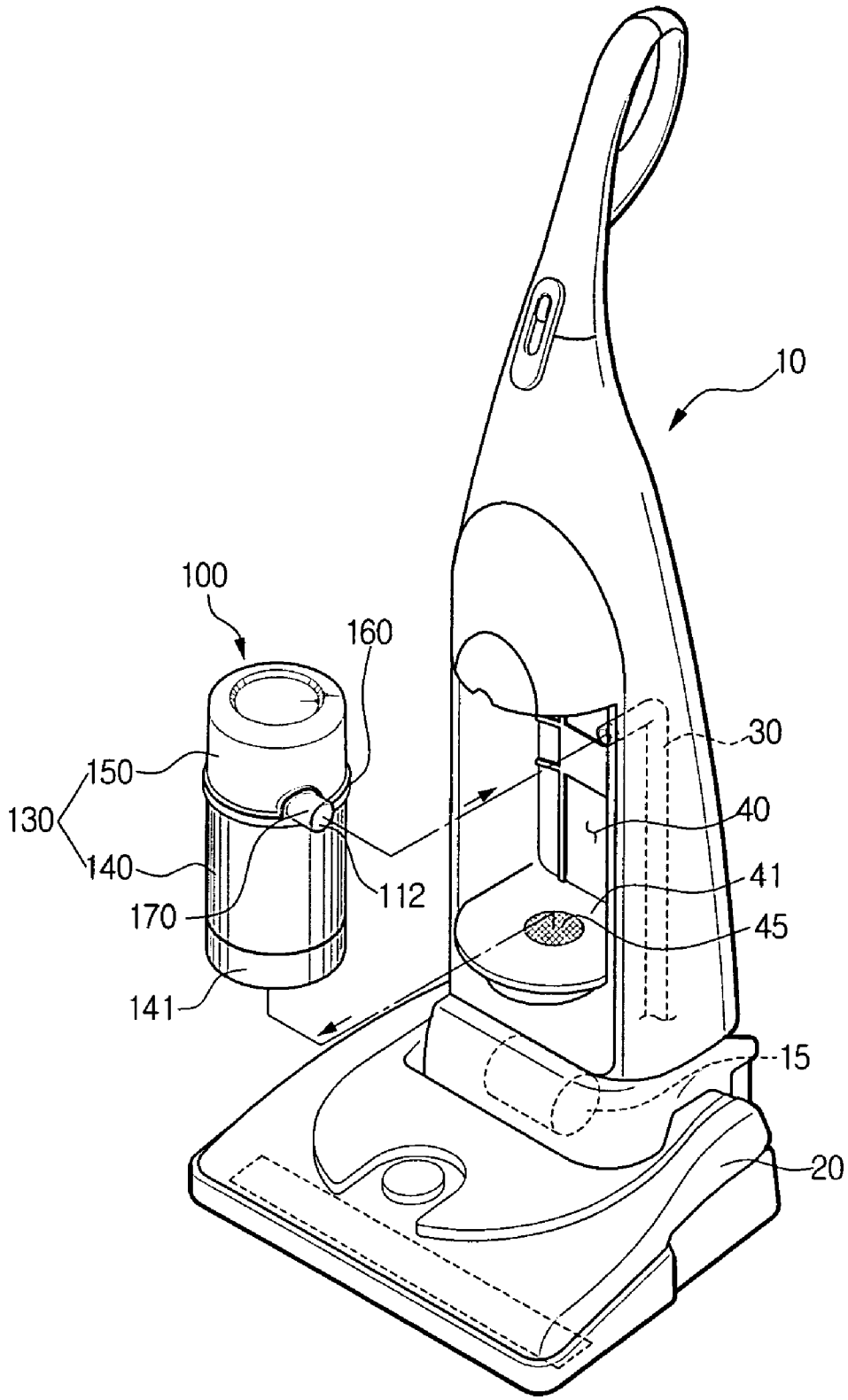
FIG. 1 is an exploded perspective view illustrating a dust collecting apparatus and a vacuum cleaner according to an embodiment of the present invention.

Hereinafter, an embodiment of the present invention will be described in detail with reference to the accompanying drawing figures.

In the following description, same drawing reference numerals are used for the same elements even in different drawings. The matters defined in the description such as a detailed construction and elements are nothing but the ones provided to assist in a comprehensive understanding of the invention. Thus, it is apparent that the present invention can be carried out without those defined matters. Also, well-known functions or constructions are not described in detail since they would obscure the invention in unnecessary detail.

Referring to FIG. 1 through FIG. 4, a dust collecting apparatus 100, adapted for use in a vacuum cleaner 10, comprises a cyclone body 130, an air inflow tube 170, and an air outlet tube 118.

The cyclone body 130 is provided with an upper case 150, a contaminant collecting receptacle 140 and a cyclone case 111.

The upper case 150 has a cylindrical shape with an opened lower end, and may contain a cutout 151 to accommodate air inflow tube 170. The contaminant collecting receptacle 140 has a cylindrical shape with an opened upper end. The contaminant collecting receptacle 140 is detachably connected with the lower end of the upper case 150 to form an outer wall of the cyclone body 130. An inside of the cyclone body 130 is divided into a cyclone chamber 110 for separating the contaminant from the air entering through the air inflow tube 170 and a contaminant collecting chamber 120 for collecting the contaminant separated in the cyclone chamber 110.

The cyclone case 111 has a cylindrical shape, the cyclone chamber 110 is formed in the cyclone case. An upper end of the cyclone chamber 110 constituted as above is surrounded by an upper sidewall 156 of the upper case 150. Here, an upper end surface of the cyclone case 111 is spaced apart from the upper sidewall 156 of the upper case 150 at a certain interval, and so a side of upper end portion of the cyclone chamber 110 is opened. The opened area functions as a contaminant discharge port 117 through which the contaminant is discharged by a centrifugal force generated by an ascending vortex current of air in the cyclone chamber 110. According to the structure, once the air drawn in the cyclone chamber 110 ascend in a whirling manner and reaches the contaminant discharge port 117, the contaminant is separated from the drawn air by a centrifugal force and then discharged through the contaminant discharge port 117 in a direction of the arrow "A" in FIG. 3. A guide member 114 guides the air drawn in through an air inlet port 112 which is an exit of the air inflow tube 170, that will be described hereinafter, to form an ascending vortex air current in the cyclone chamber 110.

Figure 4:
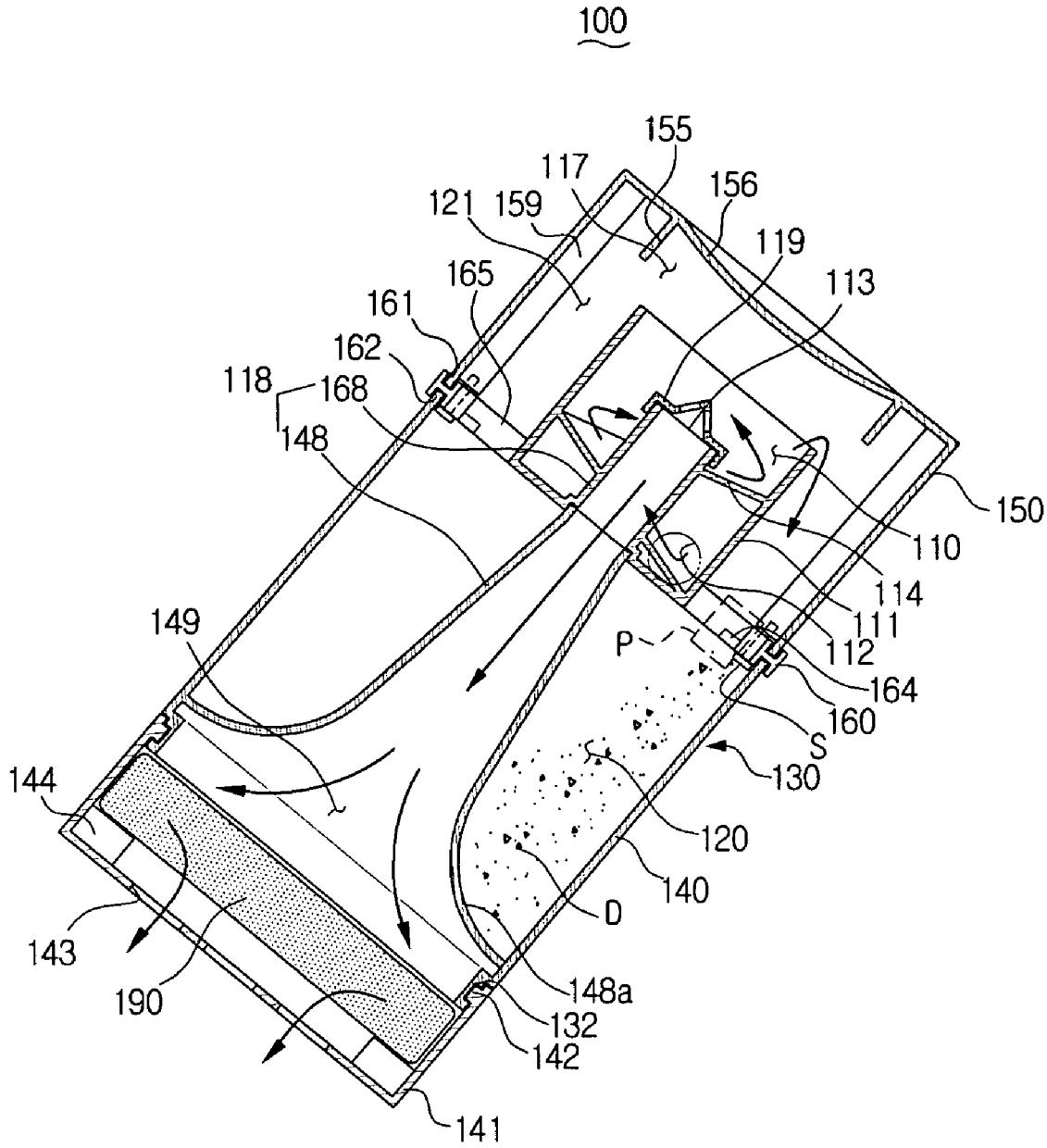
FIG. 4 is a sectional view showing another operating state of the dust collecting apparatus according to the embodiment of the present invention.

The cyclone case 111 has a closed lower end and is placed at an upper side of the contaminant collecting chamber 120, and so the cyclone chamber 110 is formed as a space separate from the contaminant collecting chamber 120. An outer side surface of the cyclone chamber is spaced apart from an inner wall surface of the upper case 150 at a certain interval. According to this structure, the cyclone chamber 110 and the contaminant collecting chamber 120 are connected with each other only through a contaminant discharge passage 121 and the contaminant discharge port 117 formed between the cyclone case 111 and the upper case 150. To this end, the cyclone case 111 in this embodiment is supported in the upper case 150 by a support body 160 and a supporting rib 165. The support body 160 has a ring shape and is disposed between the upper case 150 and the contaminant collecting receptacle 140 so that the support body 160 is fixed to the cyclone body 130 when the upper case 150 and the contaminant collecting receptacle 140 are combined with each other. In order to maintain airtightness inside of the cyclone body 130 when the upper case 150 is combined with the contaminant collecting receptacle 140, the support body 160 is provided with receiving grooves 161 and 162 for receiving a lower end of the upper case 150 and an upper end of the contaminant collecting receptacle 140. A screw combining member S may be used to securely connect the support body 160 with the upper case 150, the screw combining member S being passed through the support body 160 and then connected with a coupling boss 159 of the upper case 150. It is preferable that the support body 160 is provided with a protrusion section 164 which is disposed in the cyclone body 130 when the support body is mounted to the cyclone body 130. Due to this structure, it is possible to prevent the contaminant collected in the contaminant collecting chamber 120 from re-ascending and to prevent the contaminant collected in the contaminant collecting chamber 120 from flowing toward the upper case 150 when the cyclone dust collecting apparatus 100 is inclined as shown in FIG. 4. On the other hand, the supporting rib 165 is installed to couple the support body 160 with the cyclone case 111. According to this structure, the cyclone case 111 is supported by the support body 160 and the supporting rib 165 for enabling the contaminant discharge passage 121 and the contaminant discharge port 117 to be formed. It is desirable that the supporting rib 165 has thickness of less than a certain value for minimizing contact between the supporting rib 165 and the contaminant D discharged and fallen from the cyclone chamber 110. In this case, in order to support more effectively the cyclone case 111, a plurality of supporting ribs 165 is provided radially about the cyclone case 111. In addition, it is desirable to dispose at least one of the supporting ribs 165 on a passage P (see FIG. 4). When the cyclone dust collecting apparatus 100 is inclined during use, the contaminant D flows to the upper case 150 along the passage P. Due to the supporting rib 165, when the cyclone dust collecting apparatus 100 is inclined, it is possible to prevent the contaminant D from entering the upper case 150.

As described previously, the contaminant collecting chamber 120 is formed in the contaminant collecting receptacle 140. The contaminant collecting chamber 120 is placed at a lower side of the cyclone chamber 110, while the upper case 150 and the contaminant collecting receptacle 140 are coupled, and so the contaminant collecting chamber 120 is connected with the cyclone chamber 110 only through the contaminant discharge port 117 and the contaminant discharge passage 121. That is, the contaminant collecting chamber 120 and the cyclone chamber 110 are formed as substantially independent spaces. According to this structure, the air flowing in the cyclone chamber 110 cannot move the contaminant D received in the contaminant collecting chamber 120, and so a backflow of the contaminant D can be prevented. In addition, since the contaminant discharge passage 121 is formed between the cyclone chamber 110 and the upper case 150, even when the cyclone dust collecting apparatus 100 is inclined during use, the contaminant D moved to the upper case 150 does not flow into the cyclone chamber 110. Also, because a contaminant collecting capacity of the contaminant collecting chamber 120 does not have relation to the cyclone chamber 110, but depends on a size of the contaminant collecting receptacle 140, the contaminant collecting capacity of the contaminant collecting chamber 120 can be flexible by varying the size of the contaminant collecting receptacle 140.

On the other hand, an unstable air flow in the cyclone dust collecting apparatus 100 according to this embodiment is most unstable at a position adjacent to the contaminant discharge port 117. Accordingly, due to the unstable air flow, the contaminant discharged to the contaminant discharge port 117 may flow back into the cyclone chamber 110. In order to solve such a problem, the cyclone body 130 in this embodiment comprises a cylindrical shaped backflow preventing protrusion 155, this backflow preventing protrusion 155 is protruded downward from the upper sidewall 156 of the upper case 150. Due to the backflow preventing protrusion 155, it is possible to prevent the contaminant discharged through the contaminant discharge port 117 from re-entering the cyclone chamber 110. It is preferable that an inner diameter of a lower end of the backflow preventing protrusion 155 is larger than that of the cyclone case 111. According to this structure, when ascending and whirling air and enters the backflow preventing protrusion 155, the radius of the whirling air is increased, and so the whirling speed of the air becomes lower. Accordingly, fine contaminant contained in the air that is not discharged through the contaminant discharge port 117, drops due to its weight in the direction of arrow "B" in FIG. 3 and then falls to the contaminant collecting chamber 120.

On the other hand, the air inflow tube 170 penetrates a sidewall of the cyclone body 130 and connects with the cyclone case 111, so that the air inflow tube 170 makes a suction passage 30 of the vacuum cleaner 10 fluidly communicate with an inside of the cyclone case 111. For reference, the suction passage 30 of the vacuum cleaner 10 is connected with a suction assembly 20 and functions as the passage through which the air drawn in from a surface to be clean is passed. In this embodiment, the air inflow tube 170 is formed integrally with the cyclone case 111, the supporting rib 165 and the support body 160. According to this structure, since the air inflow tube 170 can be installed at the upper case 150 together with the cyclone case 111 when mounting the cyclone case 111, the structure of the cyclone dust collecting apparatus 100 can be simplified. In this case, additionally, the air inflow tube 170 can support the cyclone case 111.

The air outlet tube 118 is provided for guiding the air discharged from the cyclone chamber 110 to a discharge passage (not shown) of the vacuum cleaner. For reference, the dust collecting apparatus of this embodiment is constituted such that the air discharged from the cyclone chamber 110 does not pass through the upper case 150, but penetrates a bottom wall of the contaminant collecting receptacle 140 and then discharged. Due to this constitution, as shown in FIG. 1, the air discharged from the dust collecting apparatus 100 is guided outside of the vacuum cleaner 10 through an air discharge opening 45 formed on a bottom surface 41 of a mounting section 40 which is a space provided for mounting the dust collecting apparatus 100 to the vacuum cleaner 10. As one example of the above structure, FIG. 1 shows that the air discharge opening 45 is formed on the mounting section 40 for connecting the air discharge opening 45 to a motor 15. According to the above structure, an inner structure of the vacuum cleaner 10 and an outer structure of the dust collecting apparatus can be simplified. To this end, the air outlet tube 118 in this embodiment comprises a first air outlet tube portion 148 and a second air outlet tube portion 168. The first air outlet tube portion 148 is protruded upward from a bottom surface of the contaminant collecting receptacle 140 and an outlet 149 formed at a lower end of the first air outlet tube covers an opened lower end surface of the contaminant collecting receptacle 140. The first air outlet tube portion 148 in this embodiment is formed such that an inner diameter thereof is gradually increased toward a lower end. According to this structure, the contaminant D accumulated in the contaminant collecting chamber 120 is accumulated on an upper surface **148*a* of the lower end of the first air outlet tube portion 148. The second air outlet tube portion 168 is protruded upward from a bottom surface of the cyclone case 111. An air discharge port 113 is formed at an upper end of the second air outlet tube portion 168, the air discharge port is an entrance of the air outlet tube 118 in which the air discharged from the cyclone chamber 110 enters. An additional grill member 119 is provided at the air discharge port 113, and so it is possible to prevent the contaminant in the cyclone chamber 110 from being drawn in directly in the air outlet tube 118. The first and second air outlet tube portions 148 and 168 are combined with each other when the cyclone case 111 is mounted, and the second air outlet tube portion 168 is formed integrally with the cyclone case 111. According to the above structure, the air outlet tube 118 can support the cyclone case 111 when the first and second air outlet tube portions 148 and 168** are combined with each other.

On the other hand, the cyclone dust collecting apparatus 100 according to this embodiment comprises a filter member 190 for filtering the air discharged from the cyclone chamber 110, which enhances the contaminant separation efficiency. To this end, the opened end of the contaminant collecting receptacle 140 is opened and closed by an additional lower cover 141, the filter member 190 is provided in a space between the contaminant collecting receptacle 140 and the lower cover 141. Here, the lower cover 141 comprises a penetrating hole 143 fluidly communicated with the outlet 149 of the air outlet tube 118 and a supporting rib 144 for supporting the filter member 190. Also, the lower cover 141 is provided with a slide protrusion 142 which is combined with a slide groove 132 formed on a side surface of a lower end of the contaminant collecting receptacle 140. According to this structure, since the filter member 190 can be mounted detachably, management of the filter member 190 becomes easier.

Figure 2:
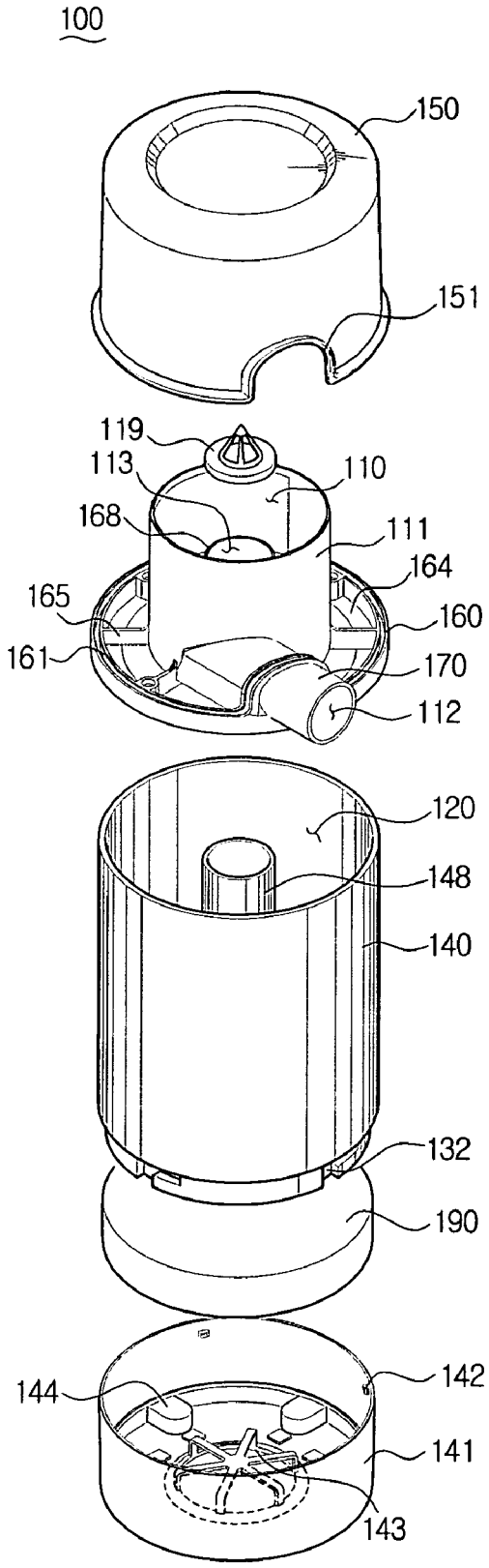
FIG. 2 is an exploded perspective view illustrating the dust collecting apparatus according to the embodiment of the present invention.
Figure 3:
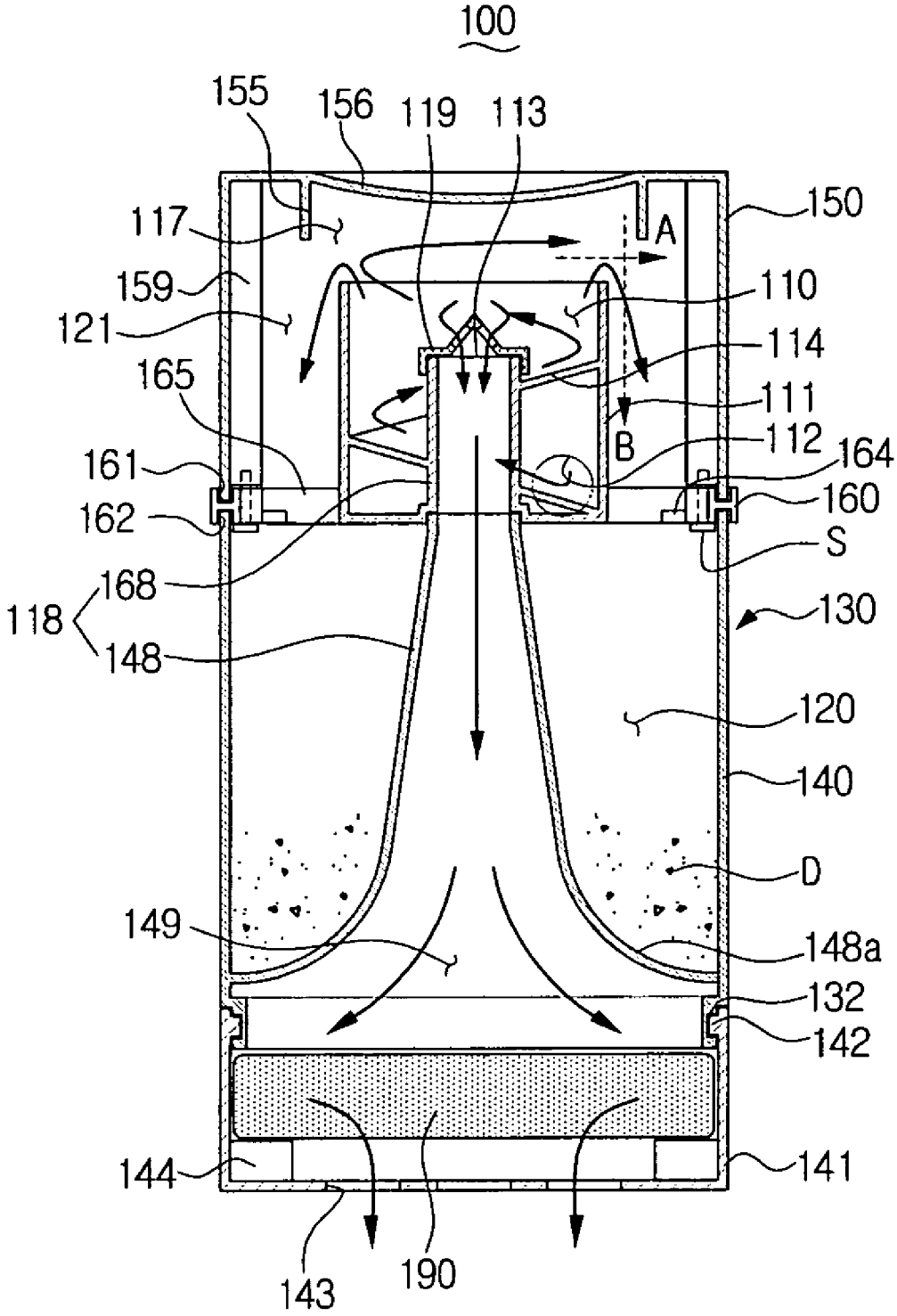
FIG. 3 is a sectional view showing an operating state of the dust collecting apparatus according to the embodiment of the present invention.

Hereinbelow, an operation of the cyclone dust collecting apparatus according to the present invention having the constitution as described above is described in detail with reference to FIG. 2 and FIG. 3.

First, once the vacuum cleaner is driven, exterior air containing the contaminant enters the inside of the cyclone chamber 110 through the air inflow tube 170. The air drawn in ascends and whirls toward the upper sidewall 156 of the upper case 150 by the guide member 114 formed into a spiral shape. The ascending and whirling air generates a centrifugal force applied to the contaminant contained in the whirling air. Due to the centrifugal force generated as described above, the contaminant contained in the air is whirled along an outermost diameter of the whirling air. Once the whirling contaminant D reaches the contaminant discharge port 117 formed at an upper end portion of the cyclone chamber 110, the contaminant is discharged to an outside of the cyclone case 111 via the contaminant discharge port 117 by the centrifugal force. On the other hand, the radius of whirling air that reaches the upper sidewall 156 is increased by the backflow preventing protrusion 155, and so the whirling speed of the air becomes lower. Once the whirling speed becomes lower as above, even fine contaminant which is not discharged through the contaminant discharge port 117 but contained in the air falls due to its own weight. The contaminant D discharged as described above goes between the cyclone case 111 and the upper case 150 and then accumulates in the contaminant collecting chamber 120 disposed at a lower side of the cyclone case 111. On the other hand, after even the fine contaminant is separated from the air at the upper sidewall 156, the air descends again and enters to the air outlet tube 118 through the air discharge port 113. For reference, the air outlet tube 118 in this embodiment is formed such that an inner diameter is gradually increased toward a lower side. With this structure, the flow rate of the air in the air outlet tube 118 is gradually reduced toward the lower end of air outlet tube 118 and therefore, fine contaminant which has not been filtrated in the cyclone chamber 110 is filtrated when the air with a slow flow rate is passed through the filter member 190. Then, the air from which fine contaminant is removed is discharged to the outside of the cyclone dust collecting apparatus 100 via the through holes 143 of the lower cover 141.

In the cyclone dust collecting apparatus according to the present invention as described above, since the cyclone chamber and the contaminant collecting chamber are formed as independent spaces, it is possible to prevent the contaminant collected in the contaminant collecting chamber from re-scattering due to air flow and from entering in the cyclone chamber.

Also, since the air discharge port is formed at a location which is spaced apart from the upper wall of the cyclone body and the backflow preventing protrusion is formed protrudedly on the upper wall of the cyclone body, although the contaminant may flow to the upper wall of the cyclone body due to a change of position of the cyclone collecting apparatus, the contaminant cannot enter in the cyclone chamber. Accordingly, the present invention has the advantage in that it is possible to prevent the contaminant from draining to the outside through the air discharge port.

Since the contaminant collecting chamber is formed at a lower side of the cyclone chamber, a contaminant collecting capacity of the dust collecting apparatus can be determined freely regardless of the cyclone chamber.

Also, because the contaminant is separated from the air drawn into the cyclone chamber through multiple steps including the cyclone chamber, the grill member and the filter member, the contaminant separation efficiency of the cyclone dust collecting apparatus can be enhanced.

While the invention has been shown and described with reference to certain embodiments thereof, it will be understood by those skilled in the art that various changes in form and details may be made therein without departing from the spirit and scope of the invention as defined by the appended claims.

What is claimed is:

1. A dust collecting apparatus for a vacuum cleaner comprising a cyclone body provided with a cyclone chamber and a contaminant collecting chamber formed therein, the cyclone chamber being a space in which air entering from the exterior of the cyclone body ascends in a whirling manner and contaminants are separated from the air by a centrifugal force generated by the air, and the contaminant collecting chamber being a space in which the contaminants separated from the air are accumulated;

a cyclone case provided in the cyclone body and disposed at an upper side of the contaminant collecting chamber, the cyclone case having the cyclone chamber and the contaminant collecting chamber separated from each other;

an air inflow tube penetrating an outer wall of the cyclone body such that a suction passage at an outside of the cyclone body is fluidly communicated with a lower end of the cyclone chamber; and an air outlet tube penetrating sequentially a bottom of the cyclone case and a bottom the cyclone body to guide the air discharged from the cyclone chamber to a discharge passage placed at an outside of the cyclone body, wherein the contaminant collecting chamber is connected to the cyclone chamber through a contaminant discharge port formed at a side surface of an upper end of the cyclone chamber, wherein the cyclone body comprises an upper case surrounding the cyclone case with a certain gap and having an opened lower end;

a contaminant collecting receptacle being combined detachably with a lower end of the upper case and having the contaminant collecting chamber formed therein;

a support body provided at a combining portion of the upper case and the contaminant collecting receptacle; and at least one supporting rib connecting the support body and the cyclone case to support the cyclone case on an upper side of the contaminant collecting receptacle, wherein the contaminants discharged through the contaminant discharge port fall due to their own weight, are passed sequentially between the cyclone case and the upper case and between the at least one supporting rib and are then collected in the contaminant collecting chamber.

2. The dust collecting apparatus according to claim 1, wherein the air inflow tube has one side fixed to the cyclone body to support the cyclone case.

3. The dust collecting apparatus according to claim 2, wherein the cyclone body comprises an upper case in which the cyclone case is provided, and a contaminant collecting receptacle having the contaminant collecting chamber formed therein, the contaminant collecting chamber being detachably combined with an opened lower end of the upper case, and wherein the air inflow tube is passed between the upper case and the contaminant collecting receptacle.

4. The dust collecting apparatus according to claim 1, wherein the air outlet tube is provided with an air discharge port formed at an upper end thereof for allowing the air discharged from the cyclone chamber to enter therein, a portion of the upper end of the air outlet tube being protruded to an inside of the cyclone chamber to dispose the air discharge port between the bottom surface of the cyclone case and the contaminant discharge port.

5. The dust collecting apparatus according to claim 4, wherein the air outlet tube comprises a first air outlet tube portion extending upward from a first portion of the bottom surface of the cyclone body and a second air outlet tube portion extending upward from a second portion of the bottom surface of the cyclone case and connected with an upper end of the first air outlet tube portion, the air outlet tube supporting the cyclone case when the first and second air outlet tube portions are connected with each other.

6. The dust collecting apparatus according to claim 4, wherein the air outlet tube is formed such that an inner diameter is gradually increased toward the bottom of the cyclone body.

7. The dust collecting apparatus according to claim 1, wherein the support body, the air inflow tube, the at least one supporting rib and the cyclone case are formed integrally with each other.

8. The dust collecting apparatus according to claim 7, wherein the support body is formed into a ring shape and is disposed between the upper case and the contaminant collecting receptacle, the at least one supporting rib being provided radially about the cyclone case.

9. The dust collecting apparatus according to claim 1, wherein a portion of the support body is protruded to an inside of the cyclone body, and the support body and the at least one supporting rib prevent the contaminant in the contaminant collecting chamber from flowing to the upper case when the cyclone body is inclined.

10. The dust collecting apparatus according to claim 1, wherein an upper end of the cyclone case and an upper sidewall of the cyclone body are spaced apart from each other at a certain distance to form the contaminant discharge port.

11. The dust collecting apparatus according to claim 10, further comprising a grill member covering the contaminant discharge port for filtering the air drawn in the contaminant discharge port.

12. The dust collecting apparatus according to claim 10, wherein the cyclone body comprises a backflow preventing protrusion being protruded downward from the upper sidewall for preventing the contaminant in the contaminant collecting chamber from re-entering to an inside of the cyclone chamber.

13. The dust collecting apparatus according to claim 12, wherein the backflow preventing protrusion is formed into a cylindrical shape and has an opened lower end disposed at an upper side of the cyclone case, and the backflow preventing protrusion has an inner diameter larger than that of the cyclone case.

14. The dust collecting apparatus according to claim 1, wherein the cyclone body has a lower cover comprising a penetrating hole for communicating the outlet of the air outlet tube with the discharge passage, and being mounted to a lower end of the cyclone body for opening and closing the lower end; and a filter member provided detachably between the lower cover and the outlet of the air outlet tube.

15. The dust collecting apparatus according to claim 1, wherein the cyclone case comprises a spirally shaped guide member for guiding the air drawn in through the air inflow tube to make the air ascend and whirl in the cyclone chamber.

* * * * *